US010774642B1

(12) United States Patent
Pan et al.

(10) Patent No.: US 10,774,642 B1
(45) Date of Patent: Sep. 15, 2020

(54) HYDRAULIC SUPPORT UNIT AND HYDRAULIC SUPPORT FOR ANTI-ROCK BURST ROADWAY

(71) Applicants: LIAONING UNIVERSITY, Shenyang (CN); Beijing Chengtian Hengye Coal Mine Equipment Co. Ltd, Beijing (CN); LIAONING TECHNICAL UNIVERSITY, Fuxin (CN)

(72) Inventors: Yishan Pan, Shenyang (CN); Hongying Wang, Beijing (CN); Zhi Tang, Fuxin (CN); Zhigao Zhang, Heze (CN); Hongqi Shi, Beijing (CN)

(73) Assignees: Liaoning University, Shenyang (CN); Beijing Chengtian Hengye Coal Mine Equipment Co. Ltd., Beijing (CN); Liaoning Technical University, Fuxin (CN)

( * ) Notice: Subject to any disclaimer, the term of this patent is extended or adjusted under 35 U.S.C. 154(b) by 0 days.

(21) Appl. No.: 16/429,154

(22) Filed: Jun. 3, 2019

(30) Foreign Application Priority Data

May 5, 2019 (CN) ..... 2019 1 0369278

(51) Int. Cl.
*E21D 15/51* (2006.01)
*E21D 15/44* (2006.01)

(52) U.S. Cl.
CPC ..... *E21D 15/44* (2013.01); *E21D 15/517* (2013.01)

(58) Field of Classification Search
CPC ..... E21D 15/44; E21D 15/517
USPC ..... 61/5 D, 63; 299/11, 31, 33; 91/17 MP; 248/357
See application file for complete search history.

(56) References Cited

U.S. PATENT DOCUMENTS 2,576,881 A * 11/1951 Kern ..... B60P 1/4414 414/557
2,654,491 A * 10/1953 Duis ..... B60P 1/4414 414/557
2,795,935 A * 6/1957 Fitzgerald ..... E21D 23/0095 405/300
2,822,938 A * 2/1958 Ormsby ..... B60P 1/4414 414/557
2,899,800 A * 8/1959 Joy ..... E21D 23/088 405/298
2,979,214 A * 4/1961 Selzer ..... B60P 1/4414 414/557

(Continued)

FOREIGN PATENT DOCUMENTS

CN 202596748 U 12/2012

*Primary Examiner* — Edwin J Toledo-Duran
(74) *Attorney, Agent, or Firm* — Volpe and Koenig, P.C.

(57) ABSTRACT

A hydraulic support unit and a hydraulic support for anti-rock burst roadway. The hydraulic support unit includes a base, a top beam, and a hydraulic support column, the top beam is positioned above the base in a spaced manner; the hydraulic support column are disposed between the base and the top beam; a side guard plate and a first base hydraulic cylinder are disposed on the left side and right side of the base, the side guard plates are rotably connected to the base, the two ends of the first base hydraulic cylinder are hinged to the base and the side guard plate respectively, the first base hydraulic cylinder can drive the side guard plate to transit between a horizontal state and a vertical state, and the bottom surfaces of the side guard plates are flush with the bottom surface of the base in the horizontal state.

10 Claims, 4 Drawing Sheets

(56) References Cited

U.S. PATENT DOCUMENTS 3,032,214 A * 5/1962 Brannan ..... B60P 1/4414 414/557
3,057,491 A * 10/1962 Schlensker ..... B60P 1/4414 414/557
3,084,815 A * 4/1963 Burbeck ..... B60P 1/4414 414/557
3,154,009 A * 10/1964 Dewyer ..... B30B 15/06 100/214
3,257,011 A * 6/1966 Randall ..... B60P 1/4414 414/557
3,320,751 A * 5/1967 Groetschel ..... E21D 23/063 405/299
3,328,966 A * 7/1967 Creuels ..... E21D 23/0409 405/300
3,357,742 A * 12/1967 Dommann ..... E21D 23/0052 299/32
3,425,229 A * 2/1969 Groetschel ..... E21D 23/0047 405/301
3,474,627 A * 10/1969 Groetschel ..... E21D 23/0454 405/296
3,505,823 A * 4/1970 Bell ..... E21D 23/0409 405/301
3,534,560 A * 10/1970 Rieschel ..... E21D 23/0418 405/290
3,563,322 A * 2/1971 Young ..... E21B 7/027 175/57
3,568,779 A * 3/1971 Cannon ..... E21B 7/028 173/44
3,592,011 A * 7/1971 Brosowski ..... E21D 23/006 405/301
3,626,700 A * 12/1971 Groetschel ..... E21D 23/0047 405/299
3,748,861 A * 7/1973 Groetschel ..... E21D 23/0436 405/297
3,802,239 A * 4/1974 Karmann ..... B21D 5/01 72/51
3,811,290 A * 5/1974 Swoager ..... E21F 13/025 405/299
3,832,856 A * 9/1974 Sigott ..... E21D 23/0418 405/302
3,840,272 A * 10/1974 Crane ..... E21D 3/00 299/56
3,848,928 A * 11/1974 Nakajima ..... E21D 23/066 299/33
3,854,295 A * 12/1974 Round ..... E21D 15/58 405/288
3,855,802 A * 12/1974 Alacchi ..... E21D 23/0052 405/297
3,871,707 A * 3/1975 Jamison ..... E21D 19/04 299/11
3,883,014 A * 5/1975 Glomski ..... B60P 1/4414 414/557
3,884,359 A * 5/1975 Suverkrop ..... B66C 23/10 212/289
3,884,494 A * 5/1975 Ashby ..... B28B 15/00 280/442
3,892,100 A * 7/1975 Jamison ..... E21D 19/04 405/291
3,902,325 A * 9/1975 Sigott ..... E21D 23/0039 405/296
3,905,426 A * 9/1975 Williams ..... E21B 19/08 173/1
3,921,409 A * 11/1975 Blumenthal ..... E21D 23/03 405/296
3,959,976 A * 6/1976 Blumenthal ..... E21D 23/0427 405/290
3,990,251 A * 11/1976 Wehner ..... E21D 23/0039 405/291
3,999,616 A * 12/1976 Crane ..... E21D 3/00 173/32
4,020,640 A * 5/1977 Sigott ..... E21D 23/0034 405/295
4,026,118 A * 5/1977 McCay, Jr. ..... B62D 33/06 405/291
4,111,317 A * 9/1978 Robinson ..... B60P 1/4414 414/680
4,138,023 A * 2/1979 Rohrs ..... B60P 1/4421 414/546
4,143,991 A * 3/1979 Stafford ..... E21D 23/0095 405/291
4,189,258 A * 2/1980 Maykemper ..... E21D 23/0086 405/291
4,190,385 A * 2/1980 Childress ..... E21D 19/02 175/219
4,217,067 A * 8/1980 Lagodka ..... E21D 23/0017 299/33
4,274,764 A * 6/1981 Curry ..... E21D 23/0418 405/291
4,307,982 A * 12/1981 Nelson ..... E21D 23/0095 405/288
4,311,344 A * 1/1982 Akesaka ..... E21D 9/104 299/33
4,312,541 A * 1/1982 Spurgeon ..... E21D 9/01 175/76
4,312,609 A * 1/1982 Culley, Jr. ..... E21D 23/0004 175/219
4,318,663 A * 3/1982 Waite ..... E02F 3/30 414/707
4,323,002 A * 4/1982 Wake ..... E21D 23/04 91/25
4,354,819 A * 10/1982 Wirz ..... B29C 33/26 425/4 R
4,404,893 A * 9/1983 Sigott ..... E21D 15/44 91/405
4,415,039 A * 11/1983 van der Lely ..... A01B 73/042 172/311
4,480,946 A * 11/1984 Kelley ..... E21D 23/0454 299/33
4,571,127 A * 2/1986 Merten ..... E21D 23/085 299/33
4,676,697 A * 6/1987 Stafford ..... E21D 23/0086 175/219
4,710,064 A * 12/1987 Stafford ..... E21D 23/0086 405/288
4,884,848 A * 12/1989 Wrulich ..... E21C 47/10 299/73
4,898,510 A * 2/1990 Weber ..... B60P 1/4414 414/557
5,176,474 A * 1/1993 Mason ..... E21D 19/04 405/291
5,306,099 A * 4/1994 Mason ..... E21D 19/04 405/291
5,474,365 A * 12/1995 von Linsingen-Heintzmann ..... E21C 25/56 299/33
5,538,364 A * 7/1996 Huntsman ..... E21D 15/54 405/288
5,584,611 A * 12/1996 Clonch ..... E21D 19/00 175/219
6,299,336 B1 * 10/2001 Hulse ..... B60Q 1/2611 362/198
7,540,693 B2 * 6/2009 Gross ..... E21C 41/16 405/290
8,282,077 B1 * 10/2012 Bonney ..... A01G 23/02 254/132
9,206,687 B2 * 12/2015 Needham ..... E21D 20/003
9,403,469 B2 * 8/2016 Parker ..... B60P 1/4414
2006/0231267 A1 * 10/2006 Wood ..... E21B 7/02 166/379
2006/0231268 A1 * 10/2006 Wood ..... E21B 7/02 166/379
2007/0107805 A1 * 5/2007 Lessard ..... B27L 7/00 144/193.2
2010/0276982 A1 * 11/2010 Niederriter ..... E21C 27/02 299/1.6

(56) References Cited

U.S. PATENT DOCUMENTS

2012/0198904 A1* 8/2012 Li ..... B21D 25/04
72/311

* cited by examiner

HYDRAULIC SUPPORT UNIT AND HYDRAULIC SUPPORT FOR ANTI-ROCK BURST ROADWAY

CROSS REFERENCE TO RELATED APPLICATIONS

This application claims priority to Chinese Application No. 201910369278.9, filed on May 5, 2019, entitled "Hydraulic Support Unit and Hydraulic Support for Anti-Rock Burst Roadway", which is specifically and entirely incorporated by reference.

FIELD OF THE INVENTION

The present invention relates to the technical field of rock burst roadway support, particularly to a hydraulic support unit and a hydraulic support for anti-rock burst roadway.

BACKGROUND OF THE INVENTION

The present invention relates to the technical field of rock burst roadway support, particularly to a hydraulic support unit and a hydraulic support for anti-rock burst roadway.

The control of surrounding rocks of deep roadways, especially, the control of surrounding rocks of rock burst roadways, is one of the theoretical bottlenecks and key problems in deep mining. Rock burst is one of the major disasters encountered in coal mining. The quantity of rock burst mines is increased as the mining depth is increased. In the future, roadway rock burst will become more prominent.

It is proven in the practice in recent years that the deformation of surrounding rock of a roadway can be controlled effectively and the rock burst of the roadway can be prevented and controlled effectively by supporting with hydraulic supports. However, existing hydraulic supports have the following drawbacks: it is inconvenient to advance and assemble the supports, the protection of the supports for the roadway sides are inadequate, the supports are not stable enough under the effect of lateral forces, and the impact load resistant performance of the supports are not satisfactory.

SUMMARY OF THE INVENTION

The object of the present invention is to provide a hydraulic support unit and a hydraulic support for anti-rock burst roadway, so as to solve at least one of the above-mentioned problems.

To attain the above-mentioned object, in one aspect, the present invention provides a hydraulic support unit for anti-rock burst roadway, which comprises:

a base which is provided with a side guard plate and a first base hydraulic cylinder on the left side and right side of the base, wherein the side guard plate are rotably connected to the base, the two ends of the first base hydraulic cylinder are hinged to the base and the side guard plate respectively, the first base hydraulic cylinder may drive the side guard plate to transit between a horizontal state and a vertical state, and the bottom surfaces of the side guard plates are flush with the bottom surface of the base in the horizontal state;

a top beam positioned above the base in a spaced manner; and a hydraulic support column disposed between the base and the top beam.

Optionally, the hydraulic support unit comprises an energy-absorbing device connected between the bottom end of the hydraulic support column and the base.

Optionally, the crushing strength of the energy-absorbing device is 1.1-1.4 times of the working resistance of the hydraulic support column.

Optionally, the hydraulic support unit comprises a telescopic guide rod connected between the base and the top beam, the bottom end of the telescopic guide rod is fixedly connected to the base.

Optionally, the hydraulic support unit comprises two hydraulic support columns disposed at the front side and back side of the telescopic guide rod in a spaced manner respectively.

Optionally, the top end of the hydraulic support column and the top end of the telescopic guide rod are hinged to the top beam.

Optionally, at least one of the left side and right side of the top beam is hinged with a first top beam hydraulic cylinder.

Optionally, at least one of the front side and back side of the top beam is hinged with a second top beam hydraulic cylinder, and at least one of the front side and back side of the base is hinged with a second base hydraulic cylinder.

Optionally, the hydraulic support unit comprises a control unit that may control the hydraulic support columns and respective hydraulic cylinders to telescope.

In another aspect, the present invention provides a hydraulic support for anti-rock burst roadway comprising the above-mentioned hydraulic support unit for anti-rock burst roadway, wherein, the hydraulic support comprises a plurality of the hydraulic support units.

Optionally, the plurality of the hydraulic support units are arranged in one row, wherein the bases of adjacent hydraulic support units are connected via the second base hydraulic cylinder, and the top beams of adjacent hydraulic support units are connected via the second top beam hydraulic cylinder.

Optionally, the plurality of the hydraulic support units are arranged in multiple rows, wherein the bases of adjacent hydraulic support units in the same row are connected via the second base hydraulic cylinder, the top beams of adjacent hydraulic support units in the same row are connected via the second top beam hydraulic cylinder, and the top beams of adjacent hydraulic support units in different rows are connected via the first top beam hydraulic cylinder.

With the technical scheme described above, when the hydraulic support unit provided in the present invention is used to support a rock burst roadway, the side guard plates may be driven by the first base hydraulic cylinder to a horizontal state to increase the contact area between the hydraulic support unit and the roadway floor; in addition, the first base hydraulic cylinder applies certain thrust force to the side guard plates so that the side guard plates stably abut against the roadway floor, and thereby the supporting stability of the hydraulic support unit in the roadway is greatly improved; moreover, the side guard plates may be driven by the first base hydraulic cylinder to rotate upward from the horizontal state, so that the side guard plates abut against the roadway sides, and thereby provide protection for the roadway sides. Therefore, the hydraulic support unit for anti-rock burst roadway provided in the present invention can improve the supporting effect for a rock burst roadway, has great practical significance and attains great social benefits for ensuring safe and efficient coal mining, saving production cost, improving economic benefits, and maintaining social stability, etc., and has extensive application prospects.

Other features and advantages of the present invention will be further detailed in the embodiments hereunder.

BRIEF DESCRIPTION OF THE DRAWINGS

The accompanying drawings are provided here to facilitate further understanding on the present invention, and constitute a part of this document. They are used in conjunction with the following embodiments to explain the present invention, but shall not be comprehended as constituting any limitation to the present invention. In the figures.

BRIEF DESCRIPTION OF SYMBOLS

10—hydraulic support unit; 11—base; 111—side guard plate; 112—first base hydraulic cylinder; 113—second base hydraulic cylinder; 12—top beam; 121—first top beam hydraulic cylinder; 122—second top beam hydraulic cylinder; 13—hydraulic support column; 14—energy-absorbing device; 15—telescopic guide rod; 16—control unit.

DETAILED DESCRIPTION OF THE EMBODIMENTS

Hereunder some embodiments of the present invention will be detailed with reference to the accompanying drawings. It should be understood that the embodiments described here are only provided to describe and explain the present invention rather than constitute any limitation to the present invention.

Figure 1:
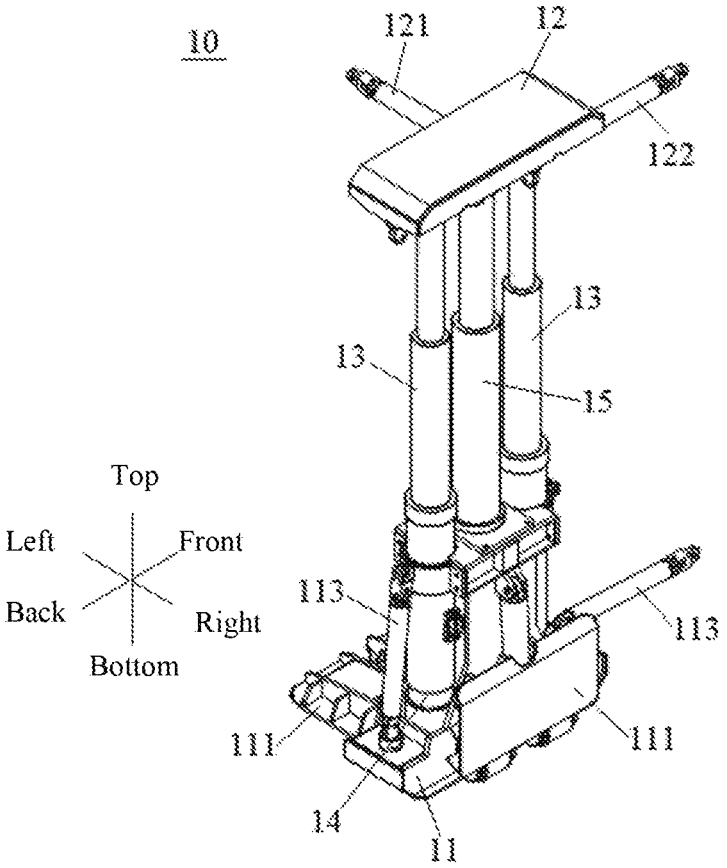
FIG. 1 is a perspective view of an embodiment of the hydraulic support unit for anti-rock burst roadway in the present invention.
Figure 2:
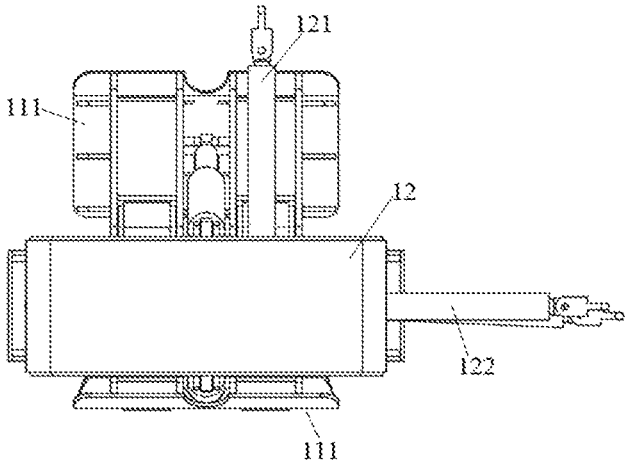
FIG. 2 is a top view of the hydraulic support unit shown in FIG. 1.

Unless otherwise described in the present invention, the terms that denote the directions or orientations, such as "upper", "lower", "top", "bottom", "front", "back", "left", and "right", usually refer to directions or orientation as indicated in FIG. 1.

Figure 4:
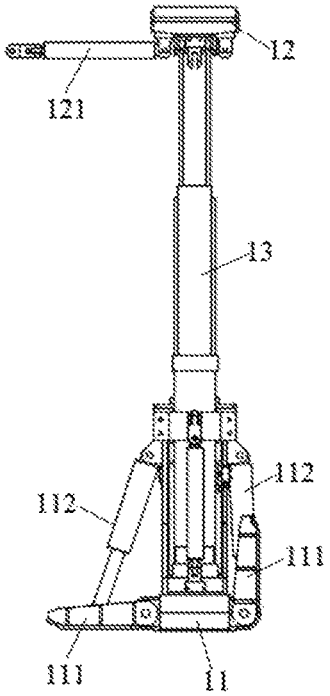
FIG. 4 is a back view of the hydraulic support unit shown in FIG. 1.

In one aspect, the present invention provides a hydraulic support unit 10 for anti-rock burst roadway, which comprises a base 11, a top beam 12, and a hydraulic support column 13, wherein, the top beam 12 is positioned above the base 11 in a spaced manner; the hydraulic support column 13 is disposed between the base 11 and the top beam 12; a side guard plate 111 and a first base hydraulic cylinder 112 are disposed on the left side and right side of the base 11, the side guard plate 111 are rotably connected to the base 11, the two ends of the first base hydraulic cylinder 112 are hinged to the base 11 and the side guard plate 111 respectively, the first base hydraulic cylinder 112 may drive the side guard plate 111 to transit between a horizontal state (see the side guard plate 111 on the left side in FIG. 4) and a vertical state (see the side guard plate 111 on the right side in FIG. 4), and the bottom surfaces of the side guard plates 111 are flush with the bottom surface of the base 11 in the horizontal state.

In the above text, it should be understood that one end of each side guard plate 111 is rotably connected to one side of the base 11; since the first base hydraulic cylinder 112 is hinged between the base 11 and the side guard plate 111, the side guard plate 111 may be driven by the first base hydraulic cylinder 112 to rotate upward from the horizontal state to the vertical state.

It should be noted that the hydraulic support column 13 and the hydraulic cylinder in the present invention refer to hydraulic actuator elements that can convert hydraulic energy into mechanical energy and move in a linear reciprocating manner. Wherein, the hydraulic support column 13 and the hydraulic cylinder can push/pull the component connected with it by telescoping. For example, in the technical scheme described above, the first base hydraulic cylinder 112 that is hinged between the base 11 and the side guard plate 111 may drive the side guard plate 111 to rotate to the horizontal state by extending or drive the side guard plate 111 to rotate to the vertical state by retracting. Moreover, the side guard plate 111 may be kept in the horizontal state, the vertical state, or at any angle between the horizontal state and the vertical state under the action of the hydraulic pressure of the first base hydraulic cylinder 112.

In the present invention, the hydraulic support units 10 may be used separately or in combination. When the hydraulic support unit 10 is used to support a rock burst roadway, the top beam 12 of the hydraulic support unit 10 may contact with the roadway roof, the bottom surfaces of the base 11 and the side guard plates 111 may contact with the roadway floor, and the side guard plates 111 may also contact with the roadway sides.

With the technical scheme described above, when the hydraulic support unit 10 provided in the present invention is used to support a rock burst roadway, the side guard plate 111 may be driven by the first base hydraulic cylinder 112 to a horizontal state to increase the contact area between the hydraulic support unit and the roadway floor; in addition, the first base hydraulic cylinder 112 applies certain thrust force to the side guard plate 111 so that the side guard plate 111 stably abut against the roadway floor, and thereby the supporting stability of the hydraulic support unit in the roadway is greatly improved; moreover, the side guard plate 111 may be driven by the first base hydraulic cylinder 112 to rotate upward from the horizontal state, so that the side guard plates 111 abut against the roadway sides, and thereby provide protection for the roadway sides. Therefore, the hydraulic support unit provided in the present invention can improve the supporting effect for a rock burst roadway, has great practical significance and attains great social benefits for ensuring safe and efficient coal mining, saving production cost, improving economic benefits, and maintaining social stability, etc., and has extensive application prospects.

In the present invention, to improve the impact load resistant performance of the hydraulic support unit 10, the hydraulic support unit 10 may further comprise an energy-absorbing device 14, which may be connected between the bottom end of the hydraulic support column 13 and the base 11.

The energy-absorbing device 14 in the present invention may be any existing energy-absorbing device, such as the energy-absorbing device provided in the Chinese patent document No. CN202596748U. In the supporting process, the energy-absorbing device 14 will not be deformed or damaged under the static pressure of the surrounding rock;

when rock burst occurs, the control unit 16 (to be introduced later) for controlling the hydraulic support column 13 has no enough time to actuate, the force borne on the hydraulic support column 13 may be greater than their working resistance and exceeds the crushing strength of the energy-absorbing device 14; in that case, the energy-absorbing device 14 will directly dissipate the impact energy of the surrounding rock by plastic deformation; at the same time, the deformation space of the energy-absorbing device 14 will provide certain energy release space for the surrounding rock and thereby indirectly dissipate the impact energy of the surrounding rock. The above-mentioned constant force deformation phase of the energy-absorbing device 14 can improve the stress condition in the hydraulic support unit 10, and protect the hydraulic support unit 10, and thereby realize strong impact resistance of the hydraulic support unit 10.

Wherein, to ensure the reliability of the energy-absorbing device 14, the crushing strength of the energy-absorbing device 14 may be set to 1.1-1.4 times (e.g., 1.2 times) of the working resistance of the hydraulic support column 13.

In the present invention, to enable the top beam 12 and the base 11 of the hydraulic support unit 10 to adapt to the roadway and different support conditions flexibly, the two ends of the hydraulic support column 13 may be hinged to the top beam 12 and the base 11 respectively, so that the top beam 12 and the base 11 may have appropriate relative movement in the horizontal direction. Of course, it should be understood that the top end of the energy-absorbing device 14 may be fixedly connected to the bottom end of the hydraulic support column 13 and the bottom end of the energy-absorbing device 14 may be hinged to the base 11, in the case that the energy-absorbing device 14 exists.

To prevent severe relative movement of the top beam 12 and the base 11 under the effect of lateral forces, in the present invention, the hydraulic support unit 10 may further comprise a telescopic guide rod 15, which is connected between the base 11 and the top beam 12, with the bottom end of the telescopic guide rod 15 fixedly connected to the base 11. The arrangement of the telescopic guide rod 15 can improve the stability of the hydraulic support unit 10 under lateral forces.

Wherein, the top end of the telescopic guide rod 15 is hinged to the top beam 12, so that the top beam 12 can adapt to roadway roofs at different angles.

Figure 3:
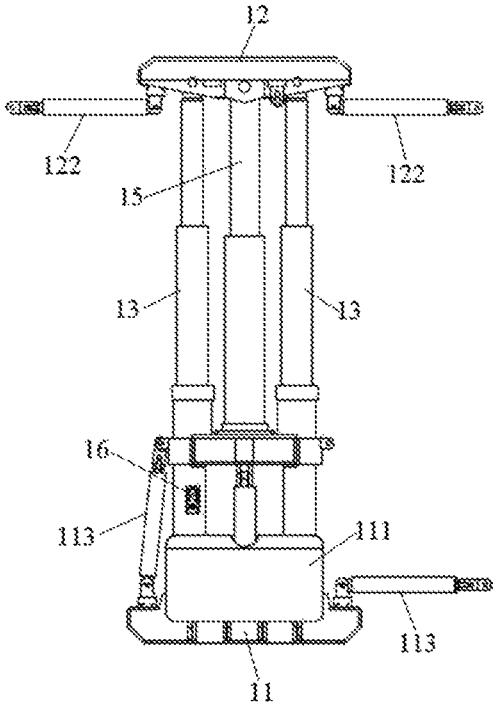
FIG. 3 is a right view of the hydraulic support unit shown in FIG. 1, with a second top beam hydraulic cylinder mounted at the back side of the top beam.

In addition, as shown in FIGS. 1 and 3, to improve the stability of the hydraulic support unit 10, the hydraulic support unit 10 may comprise two hydraulic support columns 13, which are disposed at the front side and back side of the telescopic guide rod 15 in a spaced manner respectively. Both the hydraulic support columns 13 and the telescopic guide rod 15 are extended in the vertical direction.

In the present invention, to enable a use of the hydraulic support unit 10 in combination and self-movement of the hydraulic support (i.e., a combination of the hydraulic support units 10), as shown in FIGS. 1-4, a second top beam hydraulic cylinder 122 may be hinged to at least one of the front side and back side of the top beam 12, and a second base hydraulic cylinder 113 may be hinged to at least one of the front side and back side of the base 11. In that way, the hydraulic support units 10 may be interconnected in the front-back direction via the hydraulic cylinders 122 and 113, and the hydraulic support may be moved automatically under the action of the hydraulic cylinders (to be detailed later).

In addition, a first top beam hydraulic cylinder 121 may be hinged to at least one of the left side and right side of the top beam 12. In that way, the hydraulic support units 10 may be interconnected in the left-right direction and kept at stable spacing in the left-right direction, and thereby the stability of the entire hydraulic support can be improved.

It should be noted that the respective hydraulic cylinders described above are removable, and the hydraulic support unit 10 may be connected with corresponding hydraulic cylinders 121, 122, and 113 according to the actual requirement for connection. Moreover, connecting structures that can be hinged with the two ends of the hydraulic cylinders may be provided on the base 11 and the top beam 12 respectively, so that the hydraulic cylinders can be carried in a storage state on the hydraulic support unit 10. For example, as shown in FIG. 3, the second base hydraulic cylinder 113 at the front side is in a working state, while the second base hydraulic cylinder 113 at the back side is in a storage state.

In the present invention, the hydraulic support unit 10 may further comprise a control unit 16, which may control the hydraulic support columns 13 and the respective hydraulic cylinders (i.e., the hydraulic cylinders 112, 113, 121, and 122 mentioned in the present invention) to telescope. Wherein, the control unit 16 may be a hydraulic control valve. As shown in FIG. 3, the hydraulic control valve may be assembled on the outer wall of the hydraulic support column 13.

In another aspect, the present invention provides a hydraulic support for anti-rock burst roadway comprising the above-mentioned hydraulic support unit 10, wherein, the hydraulic support comprises a plurality of the hydraulic support units 10.

Wherein, according to one embodiment of the present invention, the plurality of the hydraulic support units 10 are arranged in one row, wherein the bases 11 of adjacent hydraulic support units 10 are connected via the second base hydraulic cylinder 113, and the top beams 12 of adjacent hydraulic support units 10 are connected via the second top beam hydraulic cylinder 122.

Figure 5:
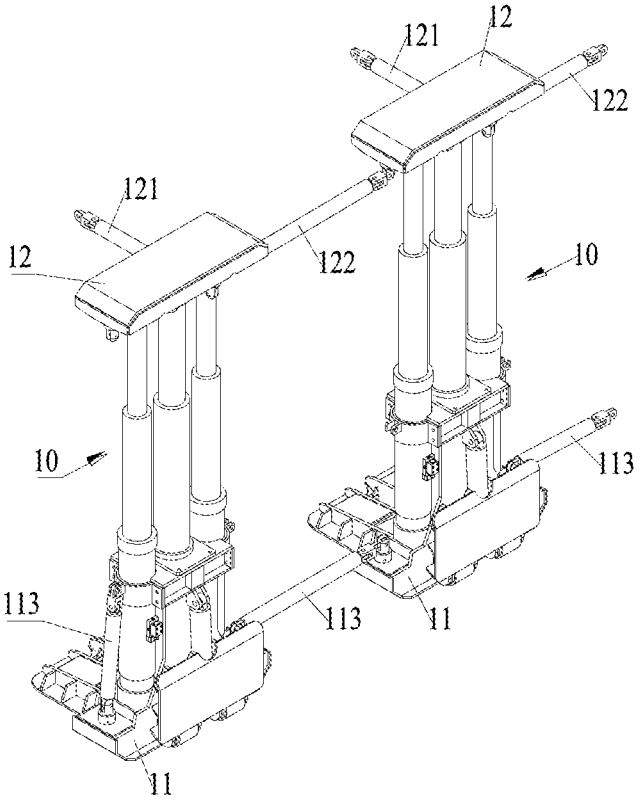
FIG. 5 is a perspective view of an embodiment of the hydraulic support for anti-rock burst roadway in the present invention.
Figure 6:
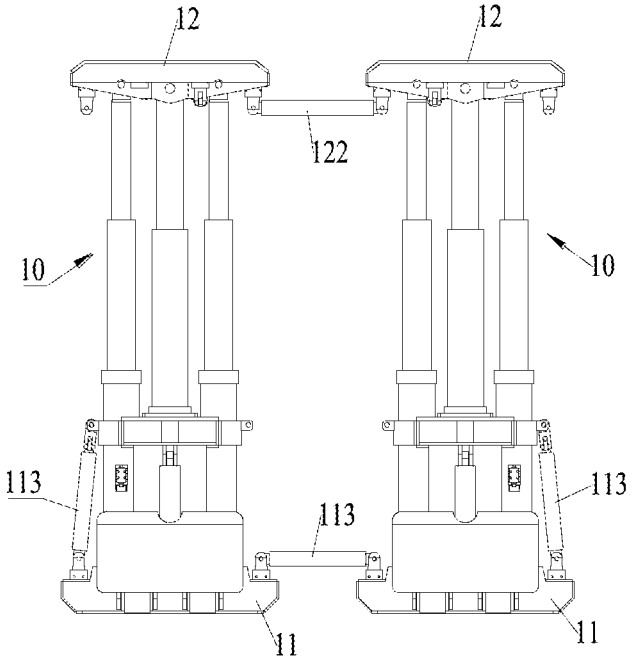
FIG. 6 is a right view of the hydraulic support shown in FIG. 5, wherein, on the hydraulic support unit on the right side, the second top beam hydraulic cylinder on the right side is removed, and the second base hydraulic cylinder on the right side is in a storage state.

Specifically, as shown in FIGS. 5 and 6, two hydraulic support units 10 are interconnected in one row, the top beams 12 of the two hydraulic support units 10 are interconnected via the second top beam hydraulic cylinder 122, the bases 11 of the two hydraulic support units 10 are interconnected with the second base hydraulic cylinder 113, the top surfaces of the top beams 12 of the two hydraulic support units 10 may contact with the roadway roof, and the bottom surfaces of the bases 11 and the side guard plates 111 may contact with the roadway floor.

The two hydraulic support units 10 connected in one row may be moved from a supporting state (in that state, the hydraulic support columns 13 of the two hydraulic support units 10 are extended so that the top beams 12 abut against the roadway roof) with the following method:

First, the hydraulic support columns 13 of the hydraulic support unit 10 on the left side are retracted, so that the top beam 12 of the hydraulic support unit 10 on the left side is detached from the roadway roof; then, the second top beam hydraulic cylinder 122 and the second base hydraulic cylinder 113 that interconnect the two hydraulic support units 10 are retracted, and the hydraulic support unit 10 on the left side is pulled to the vicinity of the hydraulic support unit 10 on the right side; next, the hydraulic support columns 13 of the hydraulic support unit 10 on the left side are extended so that the top beam 12 of the hydraulic support unit 10 on the left side abuts against the roadway roof, and the hydraulic support columns 13 of the hydraulic support unit 10 on the right side are retracted so that the top beam 12 of the hydraulic support unit 10 on the right side is detached from the roadway roof; then, the second top beam hydraulic cylinder 122 and the second base hydraulic cylinder 113 that interconnect the two hydraulic support units 10 are extended, and the hydraulic support unit 10 on the right side is pushed away from the hydraulic support unit 10 on the left side; next, the hydraulic support columns 13 of the hydraulic support unit 10 on the right side are extended so that the top beam 12 of the hydraulic support unit 10 on the right side abuts against the roadway roof, and the hydraulic support columns 13 of the hydraulic support unit 10 on the left side are retracted so that the top beam 12 of the hydraulic support unit 10 on the left side is detached from the roadway roof. By repeating the movements cyclically, the hydraulic support can be move automatically.

According to another embodiment of the present invention, the plurality of the hydraulic support units 10 are arranged in multiple rows, wherein the bases 11 of adjacent hydraulic support units 10 in the same row are connected via the second base hydraulic cylinder 113, the top beams 12 of adjacent hydraulic support units 10 in the same row are connected via the second top beam hydraulic cylinder 122, and the top beams 12 of adjacent hydraulic support units 10 in different rows are connected via the first top beam hydraulic cylinder 121.

Figure 7:
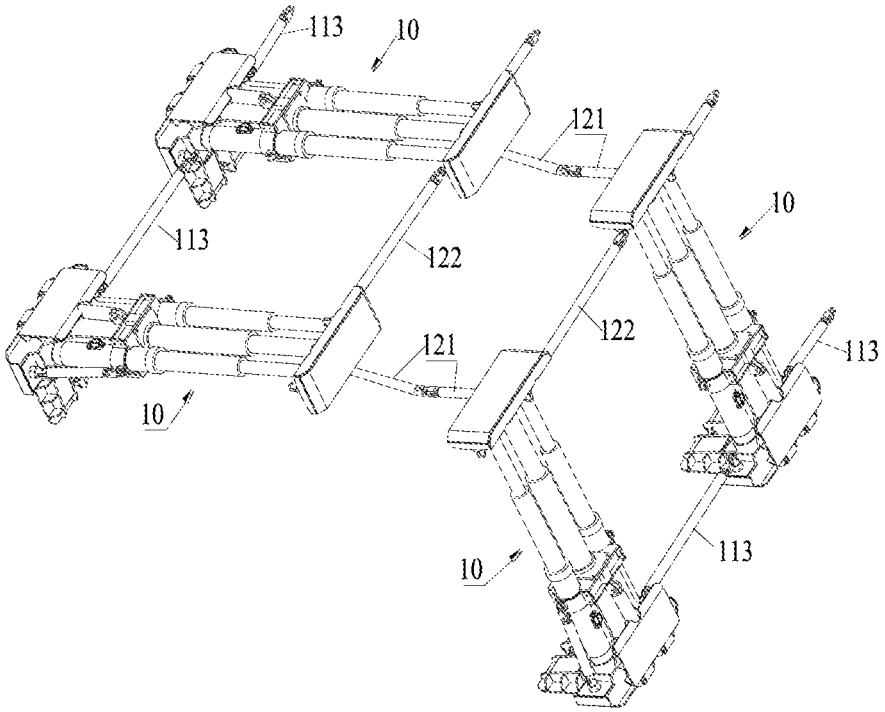
FIG. 7 is a perspective view of another embodiment of the hydraulic support for anti-rock burst roadway in the present invention, wherein, the two-row hydraulic support is shown in a symmetric manner in order to show the structure entirely.
Figure 8:
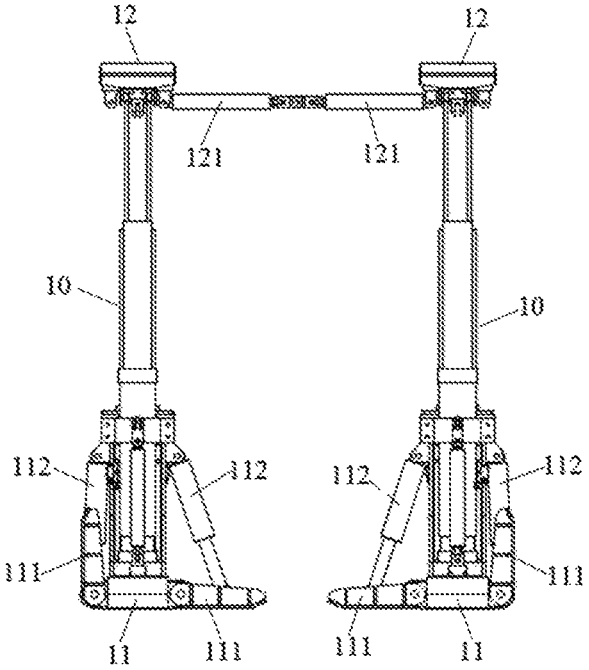
FIG. 8 is a back view of the hydraulic support shown in FIG. 7.

Specifically, as shown in FIGS. 7 and 8, four hydraulic support units 10 are interconnected in two rows. For the convenience of description, the four hydraulic support units 10 in FIG. 7 are numbered, wherein, the hydraulic support unit 10 at the top left position is numbered as hydraulic support unit I, the hydraulic support unit 10 at the bottom left position is numbered as hydraulic support unit II, the hydraulic support unit 10 at the bottom right position is numbered as hydraulic support unit III, and the hydraulic support unit 10 at the top right position is numbered as hydraulic support unit IV. As shown in the figure, the top beams 12 of the hydraulic support unit I and IV are connected with the top beams 12 of the hydraulic support unit II and III via the second top beam hydraulic cylinders 122 respectively, and the bases 11 of the hydraulic support units I and IV are connected with the bases 11 of the hydraulic support units II and III via the second base hydraulic cylinders 113 respectively; the top beams 12 of the hydraulic support units I and II are connected with the top beams 12 of the hydraulic support units IV and III via the first top beam hydraulic cylinders 121 respectively, the top surfaces of the top beams 12 of the four hydraulic support units 10 contact with the roadway roof to protect the roadway roof, the bottom surfaces of the bases 11 contact with the roadway floor to protect the roadway floor, the side guard plates 111 in a vertical state contact with the roadway sides (i.e., two side walls) to protect the roadway sides, and the side guard plates 111 in a horizontal state contact with the roadway floor.

The four hydraulic support units 10 interconnected in two rows may be moved automatically by striding, as the coal mining face is advanced. The movement method of the four hydraulic support units 10 interconnected in two rows is similar to that of the hydraulic supports interconnected in one row, and will not be further detailed here.

It should be noted that whether the hydraulic supports in the present invention are interconnected in one row or in multiple rows may be determined comprehensively according to factors such as the cross-sectional dimensions of the roadway and the stress intensity in the surrounding rock.

The hydraulic support for anti-rock burst roadway provided in the present invention has the following advantages: the hydraulic support has strong impact resistance performance, and is applicable to rock burst roadway support; can protect the roadway sides; can improve the stability of the hydraulic support under lateral forces; is easy to assemble; has self-movement ability, and can improve the efficiency of rock burst roadway support; has great practical significance and great social benefits for ensuring safe and efficient coal mining, saving production cost, improving economic benefits, and maintaining social stability, etc., and has extensive application prospects.

While some preferred embodiments of the present invention are described above with reference to the accompanying drawings, the present invention is not limited to the details in those embodiments. Those skilled in the art can make modifications and variations to the technical scheme of the present invention, without departing from the spirit of the present invention. However, all these modifications and variations shall be deemed as falling into the scope of protection of the present invention.

In addition, it should be noted that the specific technical features described in above embodiments can be combined in any appropriate form, provided that there is no conflict. To avoid unnecessary repetition, the possible combinations are not described specifically in the present invention.

Moreover, different embodiments of the present invention may also be combined freely as required, as long as the combinations don't deviate from the ideal and spirit of the present invention. However, such combinations shall also be deemed as falling into the scope disclosed in the present invention.

What is claimed is:

1. A hydraulic support unit for anti-rock burst roadway, comprising:

a base having a front side extended in front direction, a back side, a left side, and a right side, the base provided with a respective side guard plate and a respective first base hydraulic cylinder on the left side and the right side of the base, wherein each side guard plate is rotably connected to the base, the two ends of each first base hydraulic cylinder are hinged to the base and the respective side guard plate, each first base hydraulic cylinder is able to drive the respective side guard plate to transit between a horizontal state and a vertical state, and the bottom surface of each side guard plate is flush with the bottom surface of the base in the horizontal state;

a top beam positioned above the base in a spaced manner and having a front side and a back side, the front side extended in the front direction; and hydraulic support columns disposed between the base and the top beam, each hydraulic support column having a bottom end proximal to the base and a top end proximal to the top beam.

2. The hydraulic support unit for anti-rock burst roadway of claim 1, comprising a respective energy-absorbing device connected between the respective bottom end of the respective hydraulic support column and the base.

3. The hydraulic support unit for anti-rock burst roadway of claim 2, wherein the crushing strength of each energy-absorbing device is 1.1-1.4 times of the working resistance of the respective hydraulic support column.

4. The hydraulic support unit for anti-rock burst roadway of claim 1, comprising a telescopic guide rod having a top end and a bottom end, and connected between the base and the top beam, the bottom end of the telescopic guide rod fixedly connected to the base, the telescopic guide rod also having a front side disposed toward the front side of the base, and a back side disposed toward the back side of the base.

5. The hydraulic support unit for anti-rock burst roadway of claim 4, the hydraulic support columns comprising two hydraulic support columns disposed at the front side and back side of the telescopic guide rod in a spaced manner respectively.

6. The hydraulic support unit for anti-rock burst roadway of claim 4, wherein the top end of each hydraulic support column and the top end of the telescopic guide rod are hinged to the top beam.

7. The hydraulic support unit for anti-rock burst roadway of claim 1, wherein (1) at least one of the left side and the right side of the top beam is hinged with a first top beam hydraulic cylinder; (2) at least one of the front side and the back side of the top beam is hinged with a second top beam hydraulic cylinder, and at least one of the front side and back side of the base is hinged with a second base hydraulic cylinder; or (3) at least one of the left side and right side of the top beam is hinged with a first top beam hydraulic cylinder, at least one of the front side and back side of the top beam is hinged with a second top beam hydraulic cylinder, and at least one of the front side and back side of the base is hinged with a second base hydraulic cylinder.

8. The hydraulic support unit for anti-rock burst roadway of claim 7, comprising a control unit that is able to control the hydraulic support columns, each first hydraulic cylinder and each second hydraulic cylinder to telescope.

9. A hydraulic support for anti-rock burst roadway, comprising the hydraulic support unit for anti-rock burst roadway of claim 7, wherein the hydraulic support comprises a plurality of the hydraulic support units.

10. The hydraulic support for anti-rock burst roadway of claim 9, wherein the plurality of the hydraulic support units are arranged in one row, wherein the bases of adjacent hydraulic support units are connected via the second base hydraulic cylinder, and the top beams of adjacent hydraulic support units are connected via the second top beam hydraulic cylinder; or the plurality of the hydraulic support units are arranged in multiple rows, wherein the bases of adjacent hydraulic support units in the same row are connected via the second base hydraulic cylinder, the top beams of adjacent hydraulic support units in the same row are connected via the second top beam hydraulic cylinder, and the top beams of adjacent hydraulic support units in different rows are connected via the first top beam hydraulic cylinder.

* * * * *